US009911401B2

(12) United States Patent
Austin

(10) Patent No.: US 9,911,401 B2
(45) Date of Patent: Mar. 6, 2018

(54) ELECTRIC GUITAR

(71) Applicant: AERO3 GUITARS, Moon Township, PA (US)

(72) Inventor: Robert Barnes Austin, Covington, WA (US)

(73) Assignee: AERO 3 GUITARS, Moon Township, PA (US)

( * ) Notice: Subject to any disclaimer, the term of this patent is extended or adjusted under 35 U.S.C. 154(b) by 0 days.

(21) Appl. No.: 15/119,174

(22) PCT Filed: Dec. 9, 2015

(86) PCT No.: PCT/US2015/064762

§ 371 (c)(1),
(2) Date: Aug. 16, 2016

(87) PCT Pub. No.: WO2016/094540

PCT Pub. Date: Jun. 16, 2016

(65) Prior Publication Data

US 2017/0011718 A1 Jan. 12, 2017

Related U.S. Application Data

(60) Provisional application No. 62/089,439, filed on Dec. 9, 2014.

(51) Int. Cl.

| | |
|---|---|
| ***G10D 1/08*** | (2006.01) |
| ***G10D 1/00*** | (2006.01) |
| ***G10D 3/02*** | (2006.01) |
| ***G10H 3/18*** | (2006.01) |
| ***G10H 1/32*** | (2006.01) |

(52) U.S. Cl.

CPC ..... *G10D 1/085* (2013.01); *G10D 1/005* (2013.01); *G10D 3/02* (2013.01); *G10H 1/32* (2013.01); *G10H 3/18* (2013.01)

(58) Field of Classification Search

CPC ..... G10D 1/085; G10D 1/08; G10D 3/02; G10D 1/00; G10D 1/005; G10D 17/00

See application file for complete search history.

(56) References Cited

U.S. PATENT DOCUMENTS

| | | | |
|---|---|---|---|
| 3,771,408 | A | 11/1973 | Wright |
| 4,339,981 | A | 7/1982 | Smith et al. |
| 4,359,923 | A | 11/1982 | Brunet et al. |
| 4,364,990 | A | 12/1982 | Haines et al. |
| 4,538,497 | A | 9/1985 | Smith et al. |
| 4,815,355 | A | 3/1989 | Cavaness et al. |

(Continued)

FOREIGN PATENT DOCUMENTS

| | | |
|---|---|---|
| DE | 202009002099 | 9/2009 |

OTHER PUBLICATIONS

U.S. Appl. No. 15/259,464, Notice of Allowance, dated Feb. 1, 2017, 12 pages.

(Continued)

*Primary Examiner* — Kimberly Lockett
(74) *Attorney, Agent, or Firm* — Kristin M. Crall; Kilpatrick Townsend & Stockton LLP

(57) ABSTRACT

Embodiments of the present disclosure relate generally to guitars or other string instruments (10) that incorporate materials that are lighter than wood. Rather than achieving weight reduction by solely removing wood, which can weaken the structural integrity of the guitar and negatively alter sound quality, this disclosure provides replacement of removed wood with materials (16) commonly used in aerospace.

22 Claims, 12 Drawing Sheets

(56) References Cited

U.S. PATENT DOCUMENTS

| | | | | |
|---|---|---|---|---|
| 6,233,825 | B1 | 5/2001 | Degroot et al. | |
| 6,683,236 | B2 | 1/2004 | Davis et al. | |
| 6,770,804 | B2 | 8/2004 | Schleske et al. | |
| 7,342,161 | B1 * | 3/2008 | Fox | G10D 3/06 84/193 |
| 7,507,885 | B2 | 3/2009 | Coke et al. | |
| 7,863,507 | B2 | 1/2011 | Ayers et al. | |
| 8,829,318 | B1 | 9/2014 | DeLafrance et al. | |
| 9,165,539 | B2 | 10/2015 | Ostosh | |
| 9,208,756 | B2 | 12/2015 | Troy | |
| 2002/0104423 | A1 * | 8/2002 | Verd | G10D 1/005 84/291 |
| 2005/0284281 | A1 | 12/2005 | Suyama et al. | |
| 2006/0070507 | A1 | 4/2006 | Nevanen et al. | |
| 2009/0183618 | A1 | 7/2009 | Luttwak et al. | |
| 2015/0101473 | A1 | 4/2015 | Seal | |

OTHER PUBLICATIONS

"Solid/Chambered/Hollow/Body/Construction", Retrieved from the Internet: URL:https://web.archive.org/web/20121225012814/http://www.warmoth.com/Guitar/Bodies/OptionsiChamberedHollow.aspx, at least as early as Dec. 25, 2012.

International Patent Application No. PCT/US2015/064762, International Search Report and Written Opinion, dated Apr. 8, 2016, 14 pages.

Ryan , "Pollice Verso pt. 1 Argonaut Guitars", Retrieved from the Internet:URL:https:jjargonautguitars.wordpress.com/2012/11/09/pollice-verso-pt-1/, at least as early as Nov. 9, 2012.

* cited by examiner

ELECTRIC GUITAR

CROSS REFERENCE TO RELATED APPLICATIONS

This application is a U.S. national phase under 35 U.S.C. 371 of International Patent Application No. PCT/US2015/064762, filed Dec. 9, 2015, titled "Electric Guitar," which claims the benefit of U.S. Provisional Application Ser. No. 62/089,439, filed Dec. 9, 2014, titled "Aero Electric Guitar infused with aerospace technology to reduce weight and improve tonal quality," the entire contents of each of which are hereby incorporated by reference.

FIELD OF THE DISCLOSURE

Embodiments of the present disclosure relate generally to guitars that incorporate materials that are lighter than wood. Rather than achieving weight reduction by removing wood, which can weaken the structural integrity of the guitar and negatively alter sound quality, this disclosure provides replacement of removed wood with materials commonly used in aerospace.

BACKGROUND

Professional guitarists as well as novice players often experience fatigue due to the weight of guitars. For example, guitarists may experience fatigue in their neck, shoulders, and arms when playing the guitar for an extended period of time. This is an undesirable side effect.

The vast majority of guitar bodies are made from wood. Wood has a resonance unmatched by other materials. It is the vibration of the wood when the strings are played that sets the tone of the guitar. Many acoustic guitar bodies have a bottom that is made of a heavier wood and a top that is made of a lighter wood. However, acoustic guitars do not require a sound that is as focused as the sound required and desired from an electric guitar. Accordingly, most electric guitar bodies are made from thick solid pieces of wood.

As a consequence, guitars made from solid pieces of wood generally have a more focused sound, but they tend to be heavier and can cause the above-described fatigue. One cheaper and lighter alternative may be a guitar made from laminates, which are thinner sheets of wood glued together. Although there are some good laminate guitars available, they generally cannot match the sound of solid-bodied guitars.

Other attempts have been made to reduce guitar weight by removing some of the wood. For example, air channels may be created in the guitar material. However, doing so weakens the structural integrity of the guitar. Removing wood may also interfere with the transmission of sonic vibrations, negatively altering the sound quality of the guitar. The air channels or air pockets may undesirably distort the sonic vibration. Other attempts have made guitars out of different types of material entirely. Some other materials explored for creating guitar bodies include acrylic and graphite. However, such guitars generally produce a lesser quality tonal response than wooden solid-bodied guitars.

The present disclosure provides desirable guitar weight reduction without weakening the structural integrity of the guitar body and without causing sound degradation.

BRIEF SUMMARY

Embodiments of the invention described herein thus provide systems and methods for designing and manufacturing guitars or other string instruments that incorporate materials that are lighter than wood, but such that the instruments still maintain desirable sound quality. Hollowed portions formed in the guitar wood body create chambers that can be filled with one or more materials commonly used in aerospace. In some examples, the use of a fabric-like material for strength and a honeycomb material used to fill hollowed portions may help provide a guitar that is substantially lighter than those currently available. The use of these materials may also help control undesirable frequencies and can help improve the sound of the guitar.

In one example, there is provided a guitar or other string instrument, comprising a wood guitar body comprising one or more hollowed portions from which wood is removed; the one or more hollowed portions filled with a honeycomb material. Embodiments may have at least one fabric-like layer positioned in the one or more hollowed portions and in contact with the honeycomb material. The fabric-like layer may be a carbon fiber face sheet. The fabric-like layer may be a resin impregnated fiberglass face sheet. There may additionally/optionally be provided one or more connecting channels between the one or more hollowed portions and a guitar pick-up location. The one or more connecting channels may comprise one or more sound transmitting/transfer tubing sections positioned therein.

There is also provided a method of manufacturing a lightweight electric guitar, comprising: providing a wood guitar body; routing one or more openings in the wood guitar body; applying a resin into the one or more openings; applying a fabric-like layer into the one or more openings; applying a honeycomb material into the one or more openings; and applying a guitar cap over at least a portion of the wood guitar body.

DETAILED DESCRIPTION

Figure 1:
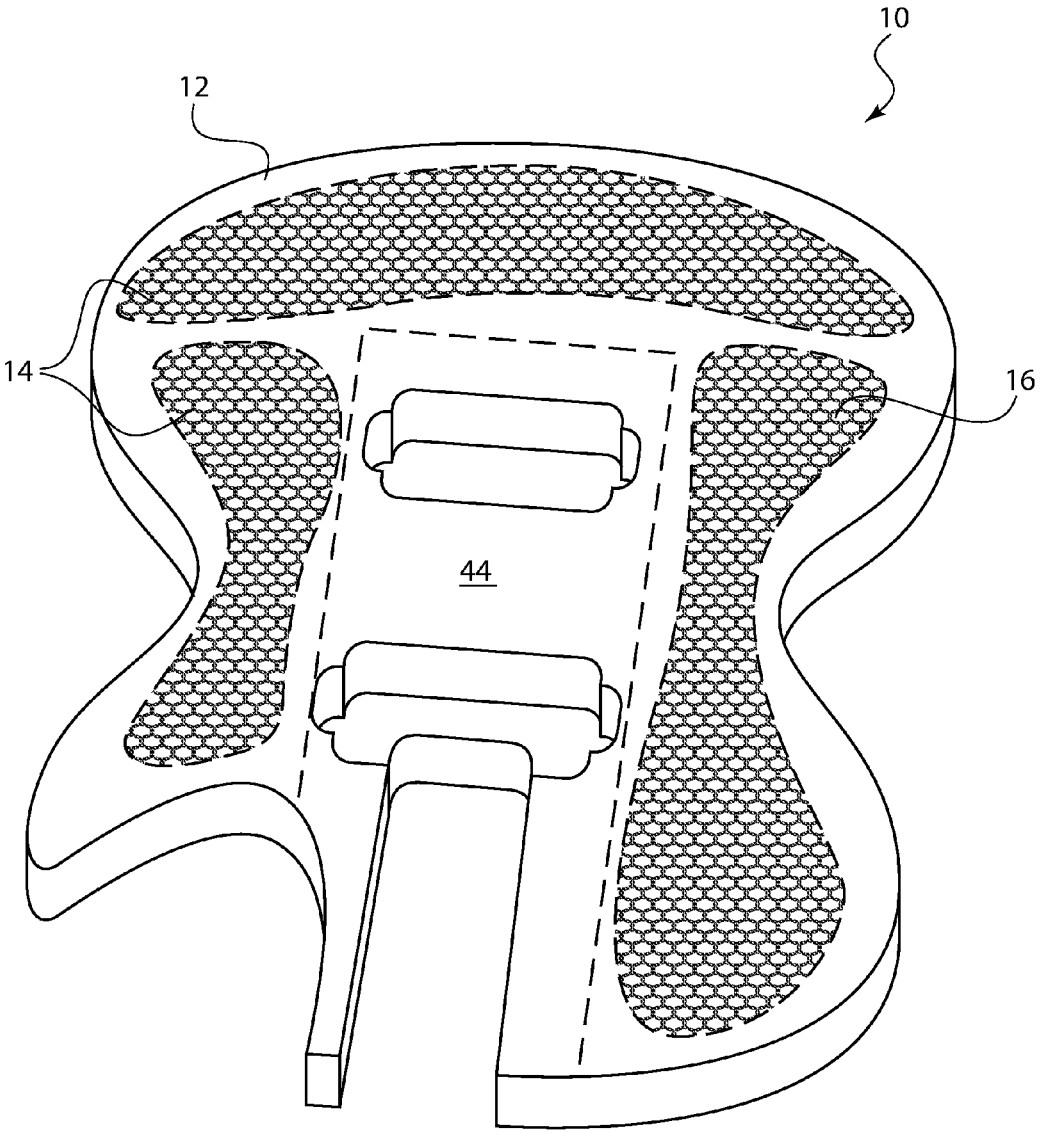
FIG. 1 shows a top perspective view of a guitar body having a honeycomb material installed in hollowed portions.

Embodiments of the present invention provide a guitar 10 that incorporates materials that are lighter than wood. The guitar 10 has a guitar body 12 that is generally made of wood, but with certain portions where the wood material is removed. For example, the removed portions may be routed out to create one or more hollowed spaces 14 in the guitar body 12. The hollowed spaces may also be referred to as chambers. The hollowed spaces 14 may be formed as grooves, as indentations, as chambers, or as any other hollowed area in the body 12. It has been found, however, that simply removing wood from the guitar body does not provide a guitar that generates the desired sound. Accordingly, once the one or more hollowed space/chambers 14 are created, they are filled with one or more materials 16 commonly used in aerospace. One example is illustrated by FIG. 1. The use of materials commonly used in aerospace (as outlined in more detail below) can reduce the weight of the guitar body by up to or possibly more than 50%, while retaining the structural integrity and strength of the guitar. Rather than losing tonal quality due to the removed materials, the tonal quality can remain the same as a solid wood guitar, or can even be improved. In use, the materials 16 can enhance the transmission of sonic vibration by providing a conduit for the sound waves.

While the majority of this disclosure relates to electric guitars, it should be understood that this disclosure also relates to any type of string instrument. For example, the embodiments described herein may be used in connection with violins, bass guitars, ukuleles, bajo guitars, cellos, or any other string instrument.

Figure 8:
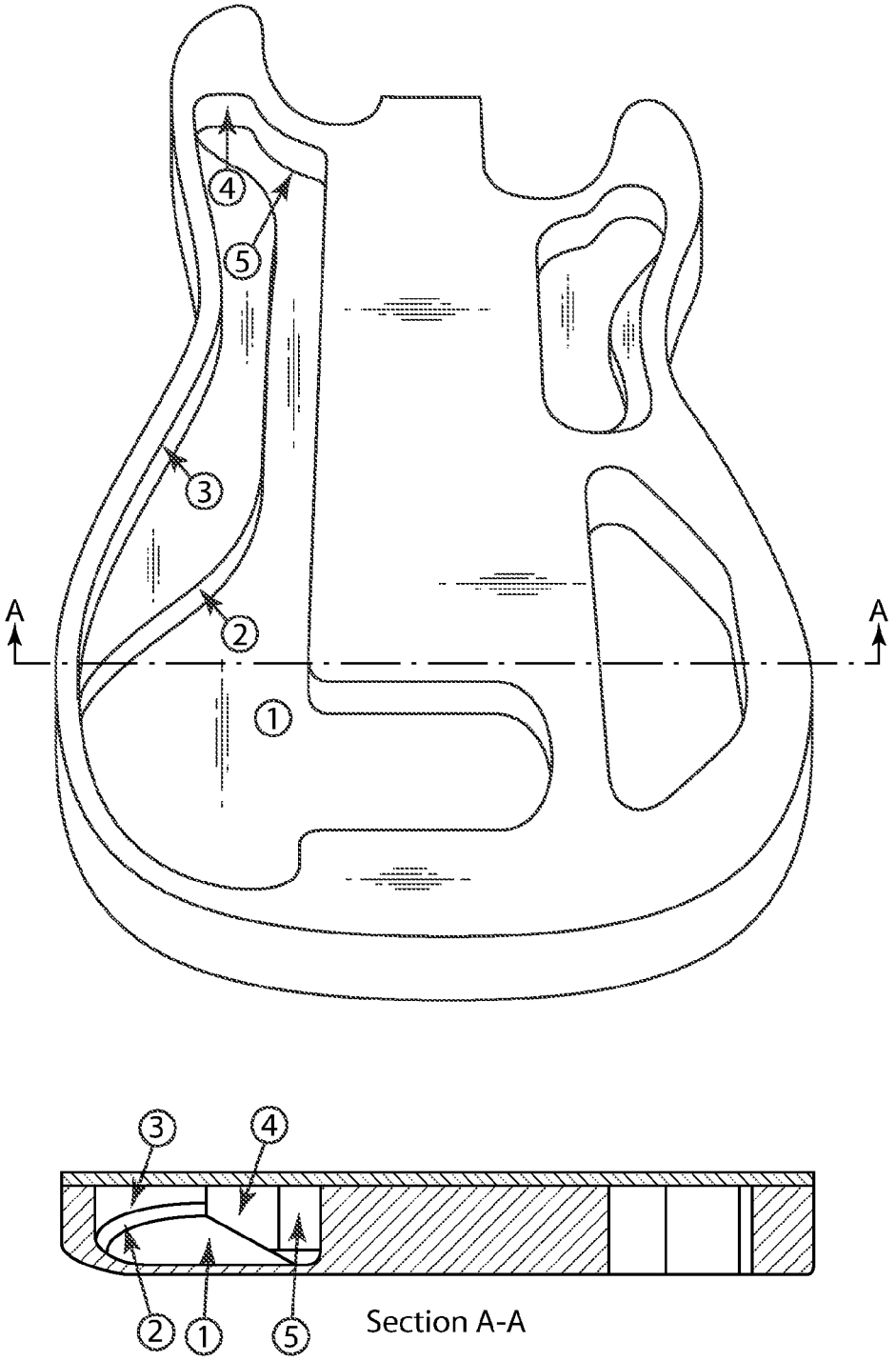
FIG. 8 shows a top plan view of various hollowed portions on a guitar body and a cross-sectional view of the guitar body.

The guitar body 12 may be any type of appropriate wood. Non-limiting examples include mahogany, alder, ash, maple, or any other type of dense wood which is believed to provide a preferred sound. In order to manufacture a guitar 10 according to embodiments of this disclosure, wood is first removed from the guitar body 12. This may be conducted using a routing process. Areas where the wood is removed may be referred to as hollowed spaces or portions 14. The hollowed portions 14 are generally formed as a chamber having a base 18 and sides 20, illustrated by FIG. 3A. As shown by FIG. 8, the hollowed portions 14 may have stepped sides, such that a hollowed portion can be multi-leveled, as illustrated by reference numerals 1-5. In other examples, the hollowed portions 14 may have smooth sides. The hollowed portions 14 may be any appropriate depth, and may depend upon the initial thickness of the guitar body 12 selected. In one example, the hollowed portion 14 may have material removed so that only about ¼ inch of wood remains to form base 18. In some options, the hollowed portion 14 may have material removed so that the remaining wood is about ⅛ inch thick. It should be understood that these examples are provided for illustration only and are not intended to be limiting in any way. In one specific example, the guitar body 12 may be about 1.75 inches thick and the hollowed portions may be about 1.5 inch deep.

Figure 2:
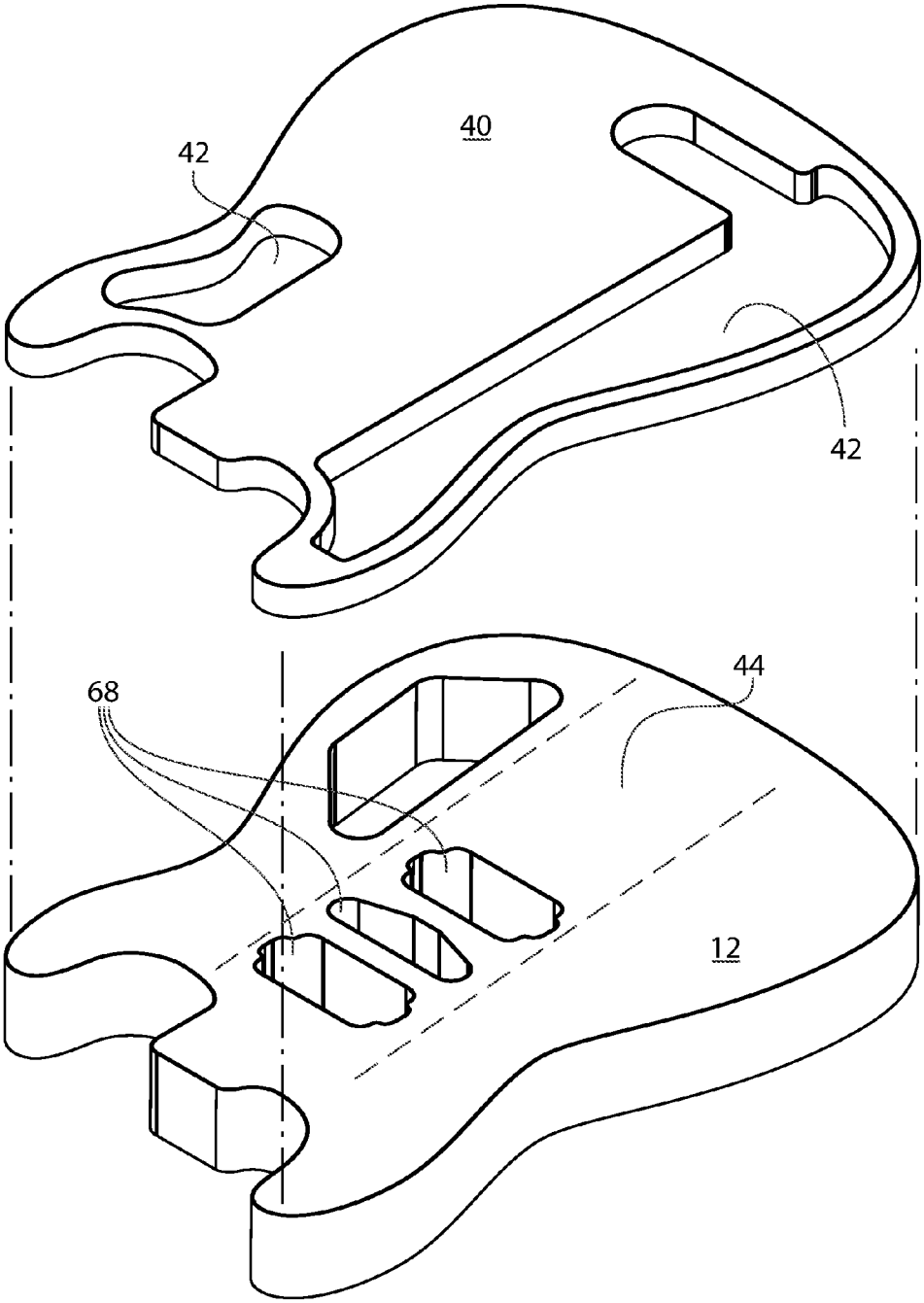
FIG. 2 shows a side perspective view of a guitar body prior to being routed via use of a template.

In order to form the hollowed portions 14, it is possible to use a routing template 40, as illustrated by FIG. 2. The routing template 40 may be positioned over the guitar body 12 and may be used to guide a router in order to create hollowed portions 14. The routing template 40 may have cut out guide portions 42 which are intended to indicate areas where material should be removed from the guitar body 12. This operation can also be completed using a multi-axis CNC Machine. A central portion 44 of the guitar body 12 is generally not hollowed. This is because equipment installation and string tension components must be provided in this portion 44. Central portion 44 generally has electronic hardware grooves 68 already formed therein. However, it is also possible for these grooves 68 to also be formed with routing template 40. These grooves 68 generally define the guitar pick-up location.

The figures provide only illustrative examples of where hollowed portions 14 may be located. For example, as shown by FIG. 1, a hollowed portion 14 may be created along a lower portion of the guitar body. One or more hollowed portions 14 may be created along one or more side portions of the guitar body. The hollowed portions may be curved, straight, hourglass shaped, peanut shaped, parallelogram shaped, L-shaped, V-shaped, elongated portions, circular portions, or any other appropriate shape for material removal. In the example shown by FIG. 1, there are three hollowed portions 14: one on either side of the guitar body 12 and one along a lower portion of the guitar body 12. In the example shown by FIGS. 3A and 3B, there are two hollowed portions 14: one along a side of the guitar that extends in an L-shape to extend along a side of the guitar body and along a lower portion of the guitar body 12 and another portion located above or otherwise adjacent to the control cavity 52. In the example shown by FIG. 4, a hollowed portion extends along a complete side of the guitar body 12 and another is positioned adjacent to the pick-up location and the control cavity. These examples are provided for illustration only. It should be understood that any location of hollowed portions that form chamber-like areas may be implemented and are considered within the scope of this disclosure and the accompanying claims.

The hollowed portions 14 may then be filled with one or more materials 16. In some examples, the materials 16 used are materials that are commonly used in aerospace. The material 16 may help maintain structural integrity of the guitar body 12 that has had significant amounts of wood removed in order to create the hollowed portions 14. In one example, the one or more materials 16 may include a honeycomb material 22 with one or more fabric-like layers 24. In another example, the honeycomb material 22 may be used alone. The materials 16 may be secured in place with a resin, an adhesive, mechanical fasteners, or any other appropriate securement method. Once the material(s) 16 are secured into place, a guitar cap 50 may be positioned over the material(s) 16 to complete the guitar 10.

Figure 3A:
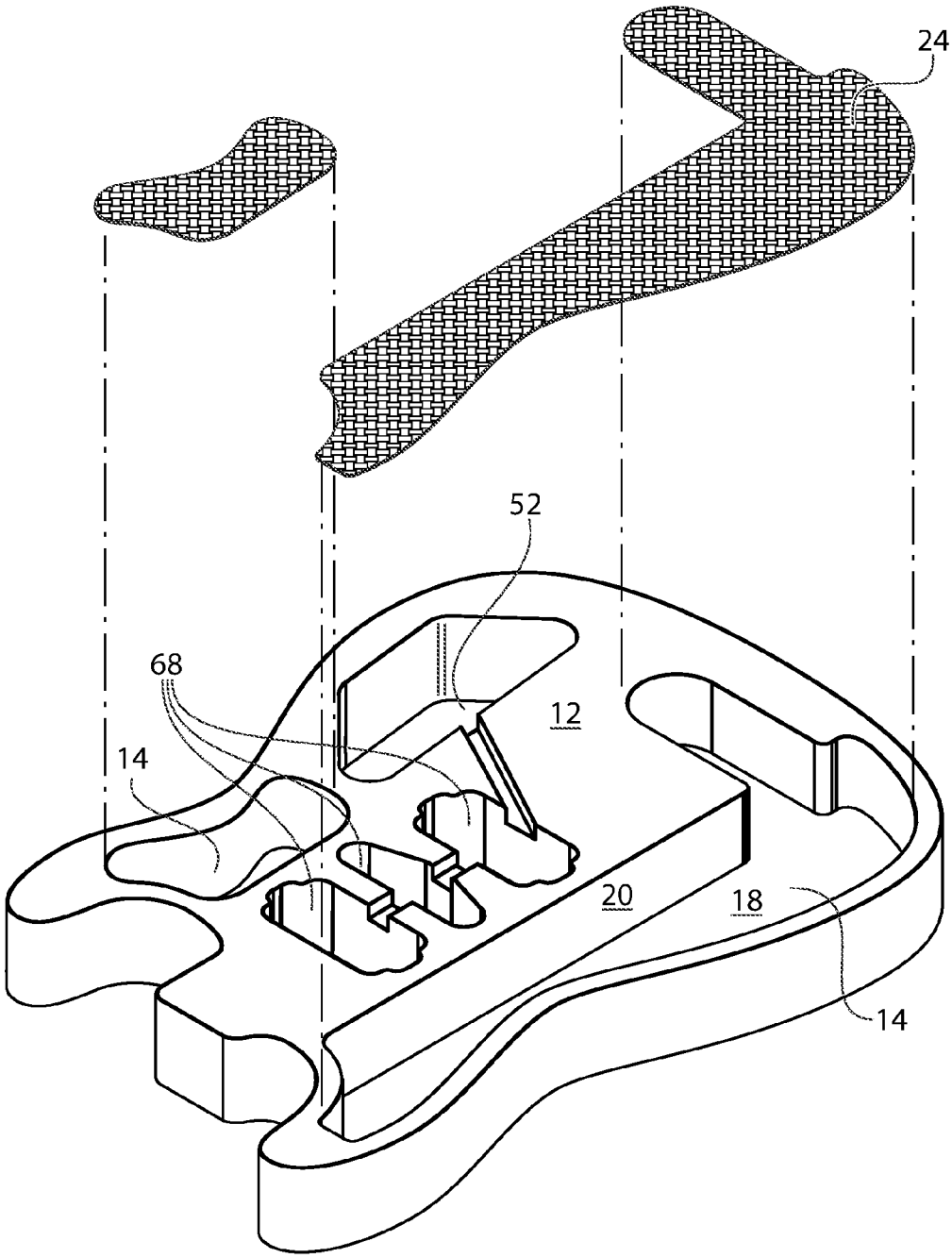
FIG. 3A shows a perspective view of a guitar body having a carbon fiber material being applied in the bottom of hollowed portion chambers.
Figure 3B:
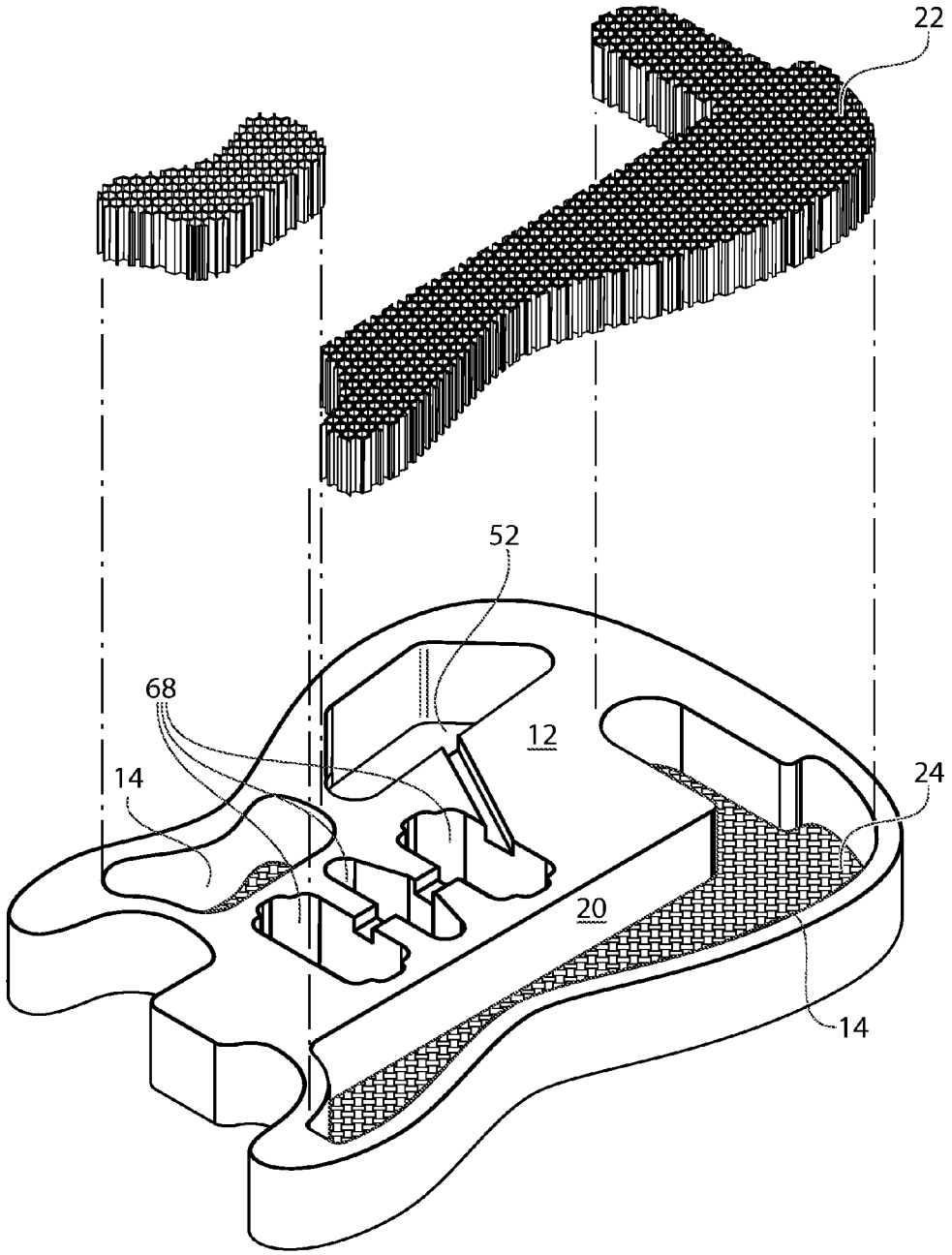
FIG. 3B shows a side perspective view of the guitar body of FIG. 3A having honeycomb material inserted into the hollow portion chambers.

FIG. 3A illustrates one example in which a fabric-like layer 24 is positioned within a hollowed portion 14. FIG. 3B illustrates a guitar body 12 with a fabric-like layer 24 positioned in the hollowed portion 14, and with a honeycomb material 22 being positioned over the layer 24 in the hollowed portion 14.

Figure 6:
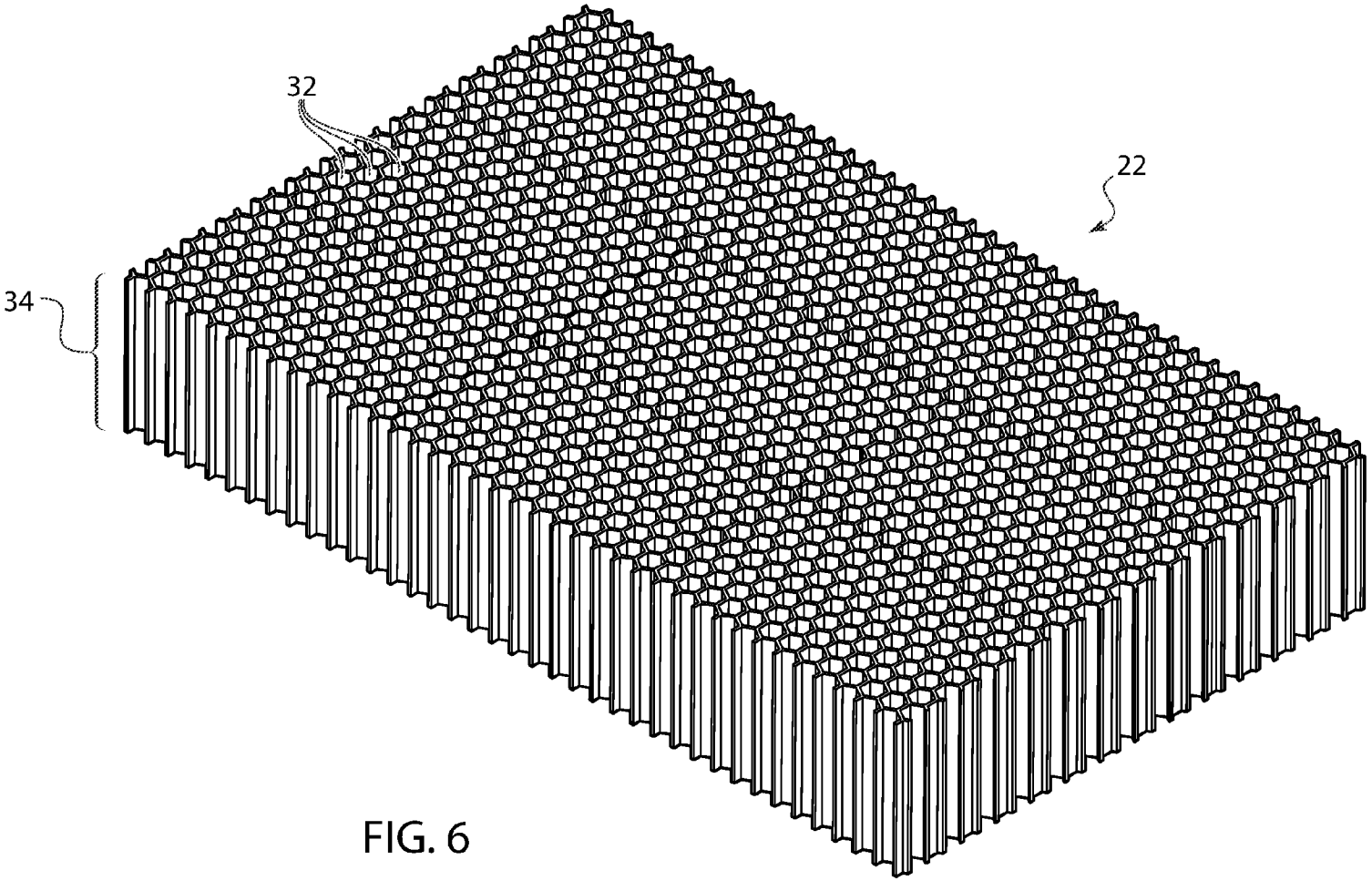
FIG. 6 shows a side perspective view of one example of a honeycomb material that may be used.

In one example, the honeycomb material 22 may be the type of honeycomb material that is traditionally used in preparing aircraft monument panels. Such aircraft panels generally have a honeycomb material sandwiched between two thin panel walls. In one example, the honeycomb material 22 may be an aramid honeycomb paper. In one example, the honeycomb material 22 may be HexWeb™ honeycomb manufactured and sold by Hexcel Corporation. This material is lightweight and provides bulk to fill the hollowed portion 14 without adding substantial weight to the guitar. One example of such a material is illustrated by FIG. 6. As shown, the honeycomb material 22 may be formed of a series of angularly-shaped tubules 32. In one example, the tubules 32 are hexagonal. However, it should be understood that any appropriate shape is possible and considered within the scope of this disclosure. Any type of honeycomb-like material may be used and is considered within the scope of this disclosure. For example, the tubules 32 may be circular, triangular, square, oval, octagonal, or any other multi-sided shaped structure. The general intent is to provide a lightweight material that provides structure without adding substantial weight. The honeycomb material generally has a density of about 2 PCF (pounds per cubic foot). Nonlimiting exemplary densities may range from about 1.5 to about 4 PCF. The tubules 32 may have a height 34 that generally approximates the amount of material removed from the hollowed space 14. In one example, the height 34 of the honeycomb material 22 may be between about 0.5 to about 2 inches. In another embodiment, the height 34 may be about 1 inch. In another embodiment, the height 34 may be about 1.5 inch. The honeycomb material core allows for the transmission of sound waves through the hollowed portion 14.

Figure 4:
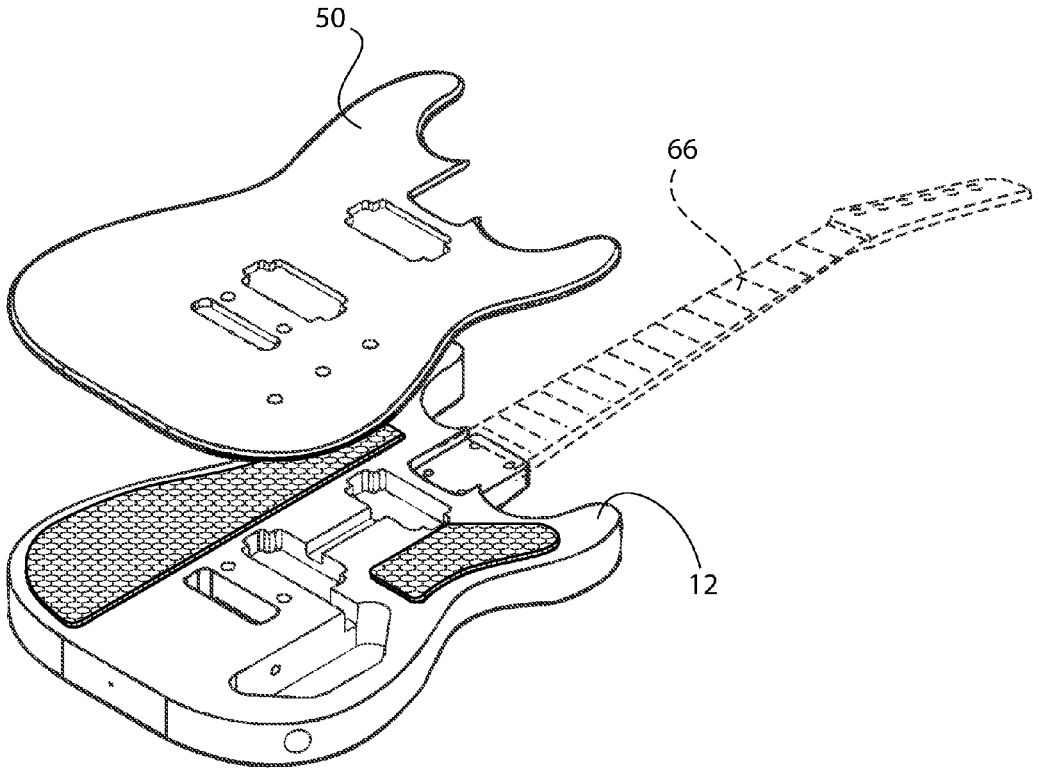
FIG. 4 shows a side perspective view of a guitar body with a guitar cap prior to being positioned.

It is possible for the material 22 to actually extend slightly above the hollowed portion 14, as illustrated by FIG. 4. In one example, providing the honeycomb material 22 extending slightly above or proud to the surface of the guitar body (prior to compression with the guitar cap 50) is believed to potentially create a desired compression, which can add to the strength and sound transmission qualities of the honeycomb material 22.

Figure 5:
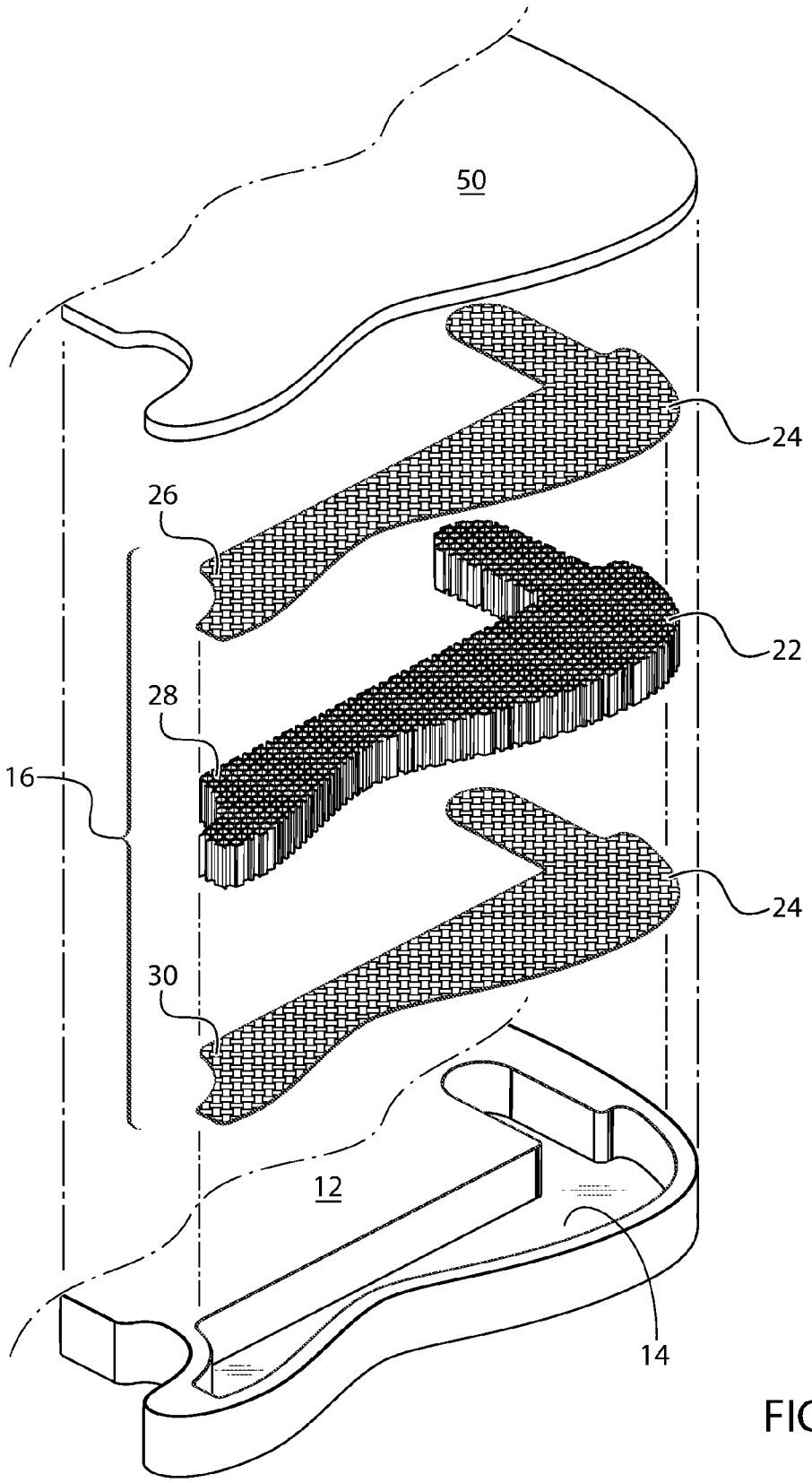
FIG. 5 shows a side exploded view of one embodiment of materials being positioned into hollowed portions of the guitar body, prior to positioning of the guitar cap.

Once the honeycomb material 22 has been positioned, the guitar 50 is positioned. However, in an alternate embodiment, it is possible to provide a layer of another fabric-like material 24 over the honeycomb material, as illustrated by FIG. 5. This second fabric-like material layer is optional.

In one example, the fabric-like layer 24 may be a carbon fiber sheet, a fiberglass cloth sheet, or any other material that can add strength to the guitar body 12 in order to compensate for the material removed. As background, aramid paper honeycomb with carbon fiber or pre-impregnated fiberglass have been used for aircraft interior panels. The materials are lightweight (of importance on aircraft, for lowering fuel costs) and provide high-strength to the aircraft panels in order to provide crush and impact resistant surfaces. These materials have not, however been used either in the music industry or in the manufacturing of musical instruments.

Figure 7:
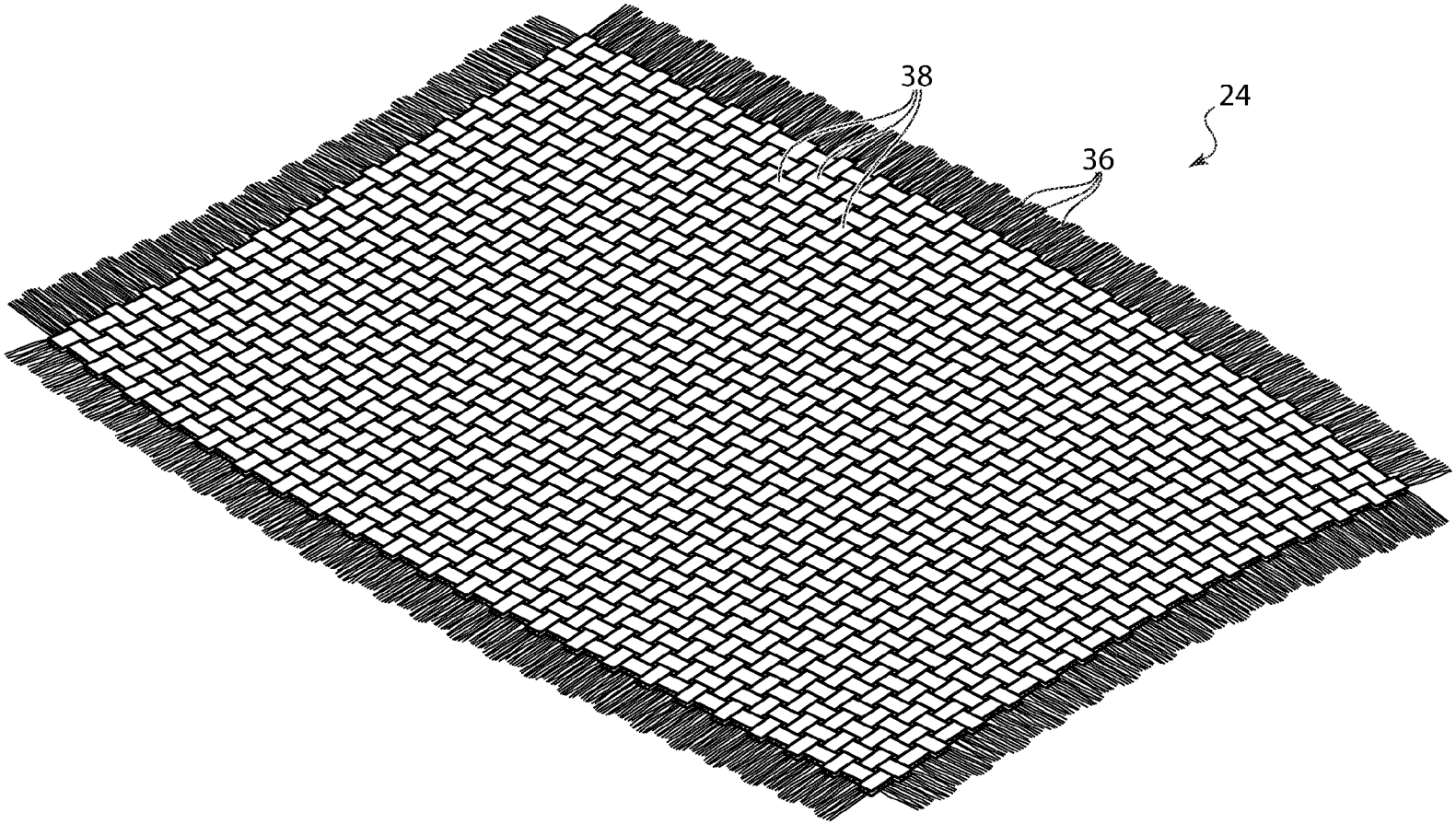
FIG. 7 shows a side perspective view of one example of a fabric-like material that may be used.

It is generally believed that a super lightweight carbon fiber may be used for high-end guitars, as this material is generally more expensive. Carbon fiber face sheets are believed to add strength to the guitar body 12 at the hollowed locations/chambers 14 where the wood was removed. A pre-impregnated fiberglass resin may be used for moderately priced guitars, as this material is generally less expensive, but it still imparts the desired strength to the guitar body. The material may be pre-cured, prior to its securement and the hollowed portion 14 via a resin. Accordingly, it is believed that fiberglass face sheets and carbon fiber face sheets may be interchangeable. They may provide or similar weight reduction/strength support in the body of the guitar. The use of a fabric-like layer 24 provides flexibility but adds strength. One example of a fabric-like layer material is illustrated by FIG. 7.

As shown, the fabric-like layer 24 may be formed of a series of interwoven strands 36 of fibers. In one example, a plurality of strands 36 form a weaving component 38. A collection of weaving components 38 may then be woven together as illustrated. Without wishing to be bound to any theory, it is believed that the tighter or narrow the weave of the fabric used (i.e., the more pics per inch/thread count), the stronger the fabric cloth may be. One theory is that a narrow gauge of thread may provide a bond line that is thin. It should be understood, however, that other materials are possible and considered within the scope of this disclosure. In one example, it is possible to use fabric materials that are used for aircraft repairs, such as for interior wall applications. However, it may be possible to use any type of woven or non-woven fabric-like material that has sufficient strength and that generates the desired sound qualities (or that does not hinder the desired sounds qualities, while adding strength).

In one example, in order to manufacture the guitar 10, after the hollowed portions 14 are formed, one or more fabric layers and a honeycomb layer may be positioned in one or more of the hollowed portions 14. In one example, the fabric layer 24 and the honeycomb material 22 may be cut into the desired shapes. The fabric layer may be a carbon fiber face sheet. The fabric layer may be a fiberglass cloth face sheet. The fabric layer face sheets may be pre-impregnated with resin or another stiffening material. Once the desired fit of these materials has been measured and tested, a layer of resin may be applied to the base 18 of the hollowed portion 14. The resin may be any appropriate type of resin. In one example, the resin may be a two-part endothermic cured resin. Nonlimiting examples of possible resins for use include but are not limited to resins (which may also be referred to as epoxy resin) supplied by West Marine® or resins (which may also be referred to as epoxy adhesives) supplied by Devcon®. The resins may generally reach a 90% cure within 24 hours, but it may take 7-14 days to reach a full cure.

Once a resin layer has been applied to the hollowed portion 14, the fabric layer 24 may be applied on top of the resin layer. It is possible for another layer of resin to be applied over the fabric layer 24. The honeycomb material 22 may be positioned over the second resin layer. A bead of glue may be applied around the perimeter of the honeycomb material 22 in order to ensure a solid bond between the honeycomb material 22 and the side of 20 of the hollow portion. Without wishing to be bound to any theory, it is believed that the use of a glue for creating as strong bond between the honeycomb material and the guitar body may provide optimum sonic transfer and can help eliminate any potential non resonant sonic vibration 14. It has been found useful to use cyanoacrylate ("CA") glue. It should be understood, however, that any appropriate word-working glue or adhesive that will ensure appropriate positioning may be used and is considered within the scope of this disclosure. It is also possible to use a CA glue (or other glue) accelerator in order to help quicken the hardening of the glue.

At this point in the process, it is generally the case that the honeycomb material 22 may extend slightly above the hollowed portion 14, as illustrated by FIG. 4. In this instance, the guitar body 12 with the materials in place may be sent through a thickness sander to bring the honeycomb 22 to the desired height. Sanding may also take place by hand or using any other appropriate method. In one specific example, the desired height may be approximately 0.001 to about 0.005 inches above the body of the guitar. In another example, the desired height may be approximately 0.003 inches above the body of the guitar. Having a slight extension of the honeycomb material 22 above the body of the guitar may allow a slight compression of the honeycomb material 22 once the guitar cap is secured.

If desired, another fabric layer 24 may be applied over the honeycomb material. This is an optional step and may be employed if the guitar cap is ultra thin, such that additional strength is necessary or desired. In another example, it is possible to coat, cover, or otherwise apply to all or a portion of the undersurface of the guitar cap with a fabric-like layer 24 in order to impart additional strength.

If a second fabric layer is used over the honeycomb material 22, the result may be that the honeycomb material 22 is sandwiched between two layers of fabric/carbon fiber face sheets 24. For example, an optional first carbon fiber sheet may form a top layer 26, the honeycomb material 22 may form an intermediate layer 28, and another carbon fiber sheet may form a bottom layer 30. An example of this configuration is illustrated by FIG. 5. The layers may be adhered to one another via a resin, adhesive, glue, or any other appropriate material. In one example, the bottom layer 30 may be cut to fit the hollowed portion 14. Resin may be poured or otherwise applied to the bottom layer 30. The carbon fiber sheet can absorb the resin. While the resin is still wet or tacky, the honeycomb intermediate layer 22 may be laid on top of the bottom layer 30. In one example, an optional top layer 26 of carbon fiber sheet may then be applied over the honeycomb layer 22. This may generally be done once the sanding height is achieved.

In another specific example, the honeycomb material 22 may be used in combination with one or more layers of fiberglass cloth face sheets 24. For example, an optional first fiberglass cloth sheet may form a top layer 26, the honeycomb material 22 may form an intermediate layer 28, and another fiberglass cloth sheet may form a bottom layer 30. The layers may be adhered to one another via a resin, adhesive, glue, or any other appropriate material. Additionally or alternatively, one or more of the fiberglass cloth sheets may be pre-impregnated with resin or another appropriate adhesive or stiffening material. In one example, the bottom layer 30 may be cut to fit the hollowed portion 14. Resin may be poured or otherwise applied to the bottom layer 30. The fiberglass cloth sheet can absorb the resin. While the resin is still wet or tacky, the honeycomb intermediate layer 22 may be laid on top of the bottom layer 30. An optional top layer 26 of fiberglass cloth sheet may then be applied over the honeycomb layer 22. This may generally be done once the sanding height is achieved. If a top layer 26 is not used, bottom layer 30 may be a fiberglass cloth sheet or bottom layer 30 may be a carbon fiber sheet.

In a further example, the bottom layer and top layer may be various combinations between a fiberglass cloth sheet or a carbon fiber sheet. For example, a fiberglass cloth sheet may be used as the bottom layer and a carbon fiber sheet may be used as the top layer. Alternatively, a carbon fiber sheet may be used as the bottom layer and a fiberglass cloth sheet may be used as the top layer. Other materials are also possible. It is believed that altering the type of fabric used may affect the guitar sound. For example, different weaves may be able to control undesirable frequencies. Alternatively, a top layer 26 is not used and only a bottom layer 30 is provided underneath the honeycomb material 22. If a top layer 26 is not used, bottom layer 30 may be a fiberglass cloth sheet or bottom layer 30 may be a carbon fiber sheet. This embodiment is illustrated by FIGS. 3B and 4.

As discussed, the honeycomb material 22 may initially extend up out of the hollowed portion 14 prior to application of the guitar 50 or top layer. If this occurs, it is possible to sand the material 22 to the desired height. If the material still extends up from the guitar surface slightly, pressure from application of the guitar cap 50 may slightly compress the materials (specifically the honeycomb layer 22) in order to give the materials more rigidity. The compression force may be induced by crushing of the honeycomb paper core 22 by the guitar cap 50. This can help provide proper tonal response. (Some of the keys to proper tonal response are the density of the honeycomb paper core and the amount of compression force induced by crushing/preloading the core.) Without wishing to be bound to any theory, it is believed that the honeycomb cells may be stiffened in compression to increase its rigidity. This can make the core structure more rigid and the membranes between the core structure more taut. For sonic transfer, this relates to the same principle as a speaker membrane that vibrates to produce and propel sound waves.

Once the honeycomb material is at the desired height, an optional top fabric-like layer 26 may be used if additional strength for the guitar cap is needed. In use, the top layer can be contoured to correspond to the shape of the honeycomb/hollowed portion 14.

Once the materials 16 are positioned, they may be optionally dried prior to proceeding with the manufacturing process. Drying may take place via air drying, light curing, sheet drying, or any other appropriate drying method. A guitar cap 50 may then be positioned over the guitar body 12. The guitar cap 50 may compress or crush the materials 16, particularly the honeycomb materials 22. This loading of the core can help improve tonal response of the guitar.

Figure 9:
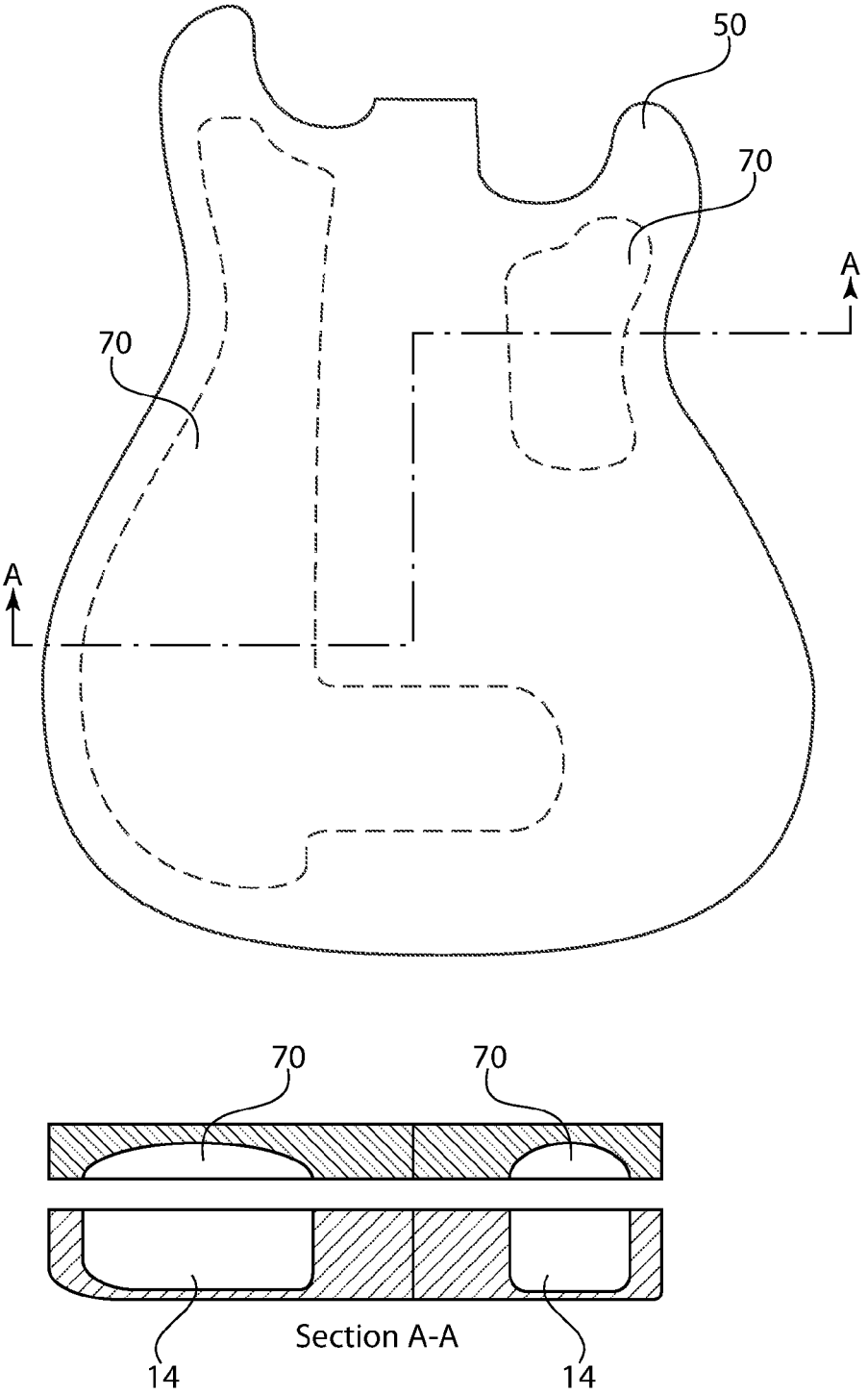
FIG. 9 shows a top plan view of an undersurface of a guitar cap having domed portions that correspond to the one or more hollowed portions of the guitar body and a cross-sectional view of the guitar cap.

Referring now to FIG. 9, it is possible for the guitar cap 50 to have an under surface formed as having a dome shape 70. The dome shape 70 may correspond to the locations where the hollowed portions 14 are formed in the guitar body 12. The concept is to make a small dome shape on the underside of the wood top cap in the locations that correspond to the honeycomb chambers. The remainder of the guitar cap 50, particularly the portion that is positioned over the control cavity, may remain flat. In another example, the entire guitar cap 50 may be formed with a slight dome shape 70. Without wishing to be bound to any theory, it is believed that providing a dome shape 70 in place of a flat underside along at least selected portions may help allow non-absorbed sound to echo off the guitar cap 50, thereby enhancing the sound vibrations delivered to the electronic pick-ups.

Optional Carbon Fiber Tubing Option

In an alternate embodiment, it is possible to add one or more sound transmitting/transfer tubing sections 46, connecting one or more hollowed portions 14 with the pick-up location 68. Specifically, the tubing section 46 may be routed from each hollowed honeycomb chamber to the underside of the pick-up cavity. The tubing sections 46 may be at least partially embedded within the honeycomb material 22. In the example illustrated by FIG. 10, channels 64 may be formed between hollowed portion 14 and electronic hardware grooves 68. Sound transmitting/transfer tube sections 46 baby positioned in channels 64.

As background, guitar manufactures do not traditionally take advantage of the underside of the guitar's pickup. Generally, pole magnets pass from the upper surface of the pickup to the lower side of the pickup enclosed by pickup rings, the guitar body, or the pickup body. The user has no access to the lower side of the body and therefore no access to the magnetic field created by the pole magnets and the copper winding that encases the magnets. Pickups create a magnetic field with the pole magnets and the copper winding surrounding the magnets. Typical guitar installations require the metallic string to vibrate at certain frequencies, thus creating the various sounds crated by an electric guitar. There are, however, forces that interrupt the magnetic field that is created and ever present from the pickups. Other forces that can interrupt the pickup magnetic field include but are not limited to, vibration of the guitar body, sound vibration from an amplified speaker, other metallic objects that the guitar player may have on their person.

Without wishing to be bound to any theory, it is believed that installation of a sound transmission conduit 46, which may also be referred to as a "tone tube," may allow the various sound waves passing through the body to be driven to the lower side of the pickup. This process can be compared to the operation of a loud speaker or to the reverse process of a microphone. In one example, a carbon tone tube 46 may be embedded in the core of the honeycomb material 22. The carbon tone tube 46 may extend across the guitar body within channels 64. The carbon tone tube 46 may be installed in any way that secures its location and reduces its motion or otherwise maintains motion to a minimum. When the honeycomb material 22 vibrates from the action of playing the guitar, sound is transmitted via the tone tune 46. As vibrations increase, sound waves of similar frequency increase.

Figure 10:
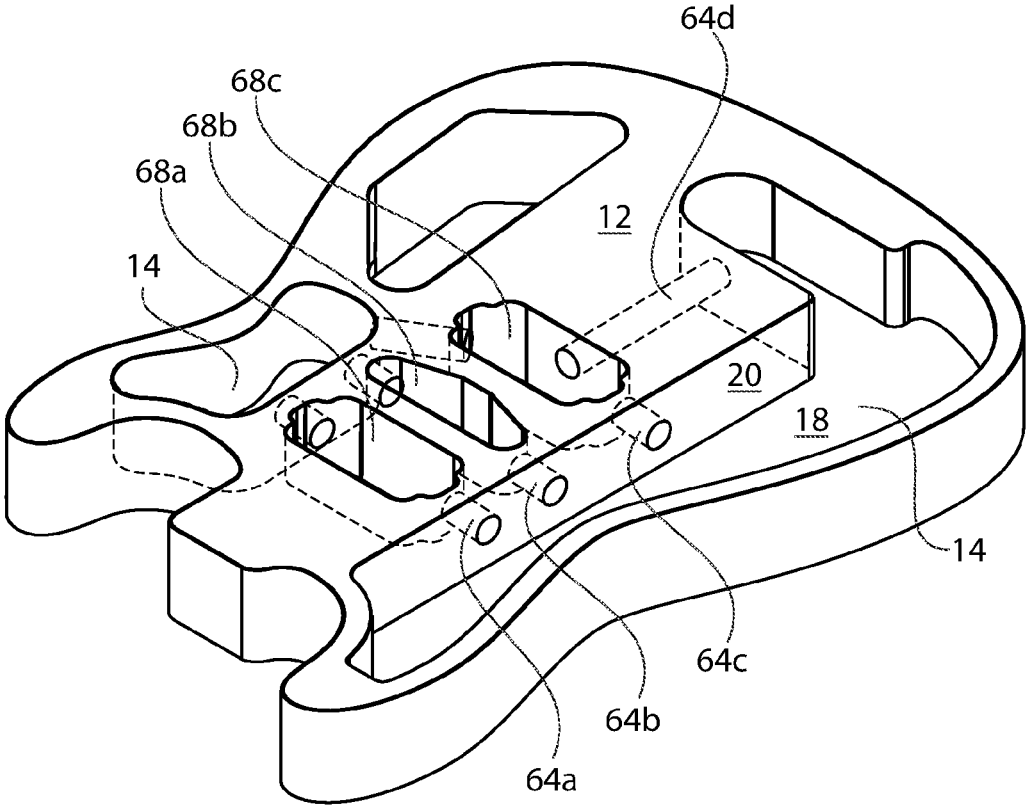
FIG. 10 shows a perspective view of a guitar body having channels for receiving one or more sound enhancing tubes.

Referring now back to FIG. 10, it is possible for a single hollowed portion 14 to have more than one channel 64 associated therewith, such that a first channel 64*a* connects the hollowed portion 14 with a first groove 68*a*, a second channel 64*b* connects the hollowed portion 14 with a second groove 68*b*, and a third channel 64*c* connects the hollowed portion 14 with a third groove 68*c*. In the example in which the hollowed portion is a L-shaped portion in two different dimensions, a fourth channel 64*d* may be provided to connect the hollow portion 14 with a lower, adjacent groove 68. The one or more channels 64 may then be routed between one or more of the hollowed portions 14 in order to create a conduit for sonic vibration. The channels 64 may be formed at the same time that the hollowed portions 14 are formed. They may generally be formed prior to insertion of any of materials 16.

Figure 11:
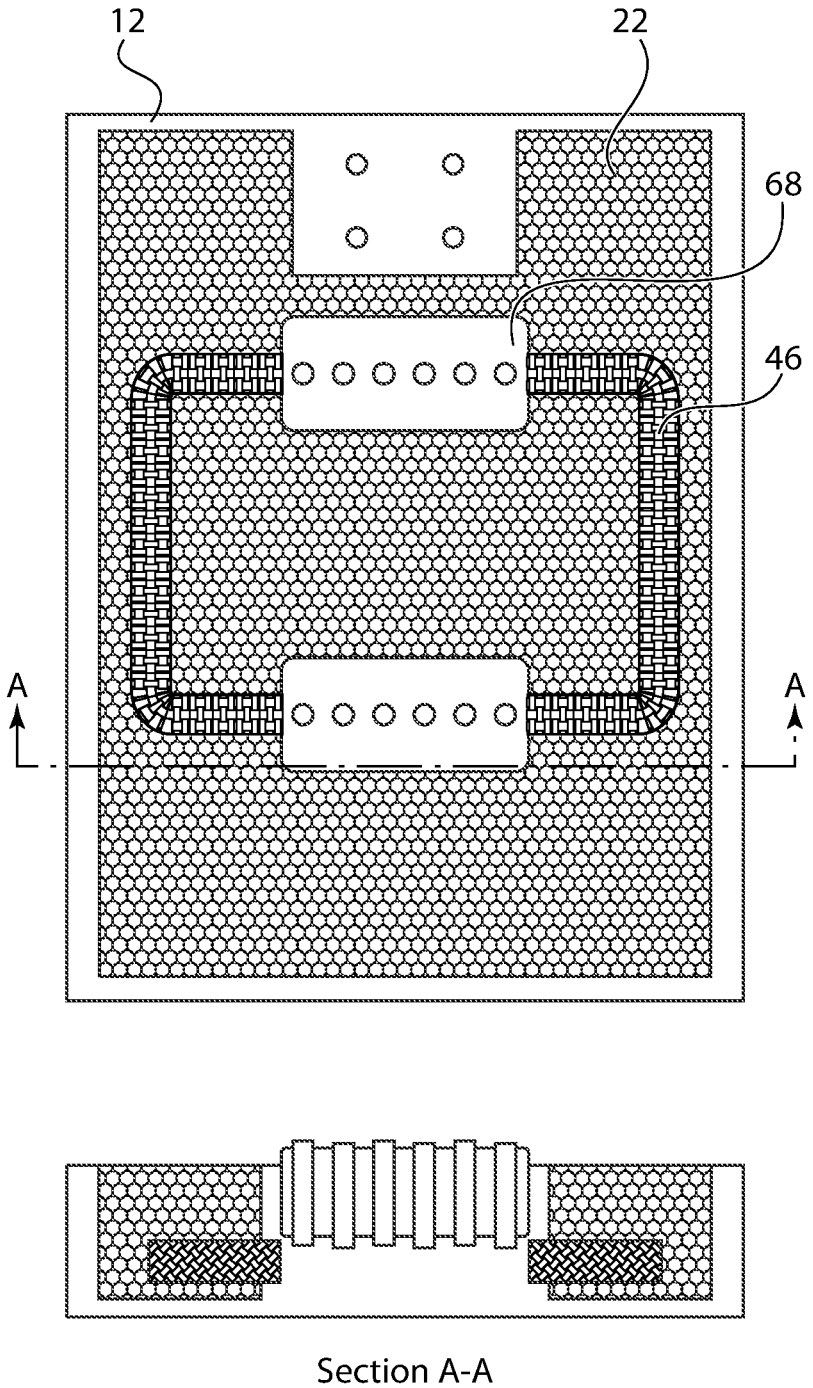
FIG. 11 shows a schematic view of a guitar body having channels and sound enhancing tubes and a cross-sectional view of such a guitar body.

Once channels 64 are formed, one or more conduits 46 (or tone tubes) of a sound transmission material or tubing may be positioned within the channels, as illustrated by FIG. 11. In one example, the sound transition material conduits 46 may be carbon fiber tubing. The carbon fiber tubing 46 may be embedded within the honeycomb material 22 and extend across or may otherwise be aligned with the one or more channels 64 formed in the guitar body in order to interconnect one or more of the hollowed portions 14 with the guitar string pickup location. As discussed, it is believed that this may help transmit sonic vibrations to the guitar string pickup location.

Without wishing to be bound to any theory, it is believed that the conduits 46 may create a conduit for the transmission of sound wave vibrations to the guitar pickup locations. The carbon fiber tubing/conduits 46 may be any appropriate dimension, non-limiting examples including a diameter of about ⅛ inch, ¼ inch, ½ inch, ¾ inch, 1 inch, or any combination thereof. They may be positioned by adhesive, friction fit, welding or any other appropriate manner. In use, the carbon fiber tubes 46 interconnect one or more of the hollowed portions 14 with the guitar string pickup location 68 create a conduit for the transmission of sonic vibration.

One option for manufacturing could be to have one manufacturing company cut out the wood and/or the channels from the guitar body 12, including all of the grooves/hollowed portions 14, as well all of the grooves 68 for the electronic hardware and the control cavity 52. Another manufacturing company could take the formed guitar bodies 12 and coordinate installation of the materials 16 and securement of the guitar cap 50 to the guitar body 12. Another manufacturing option would be for a single company to conduct the routing, aerospace material 16 installation, and guitar cap 50 securement steps. That same company could either stain, paint, or spray the completed guitar 10. Or the company could provide the guitar to another company for staining/painting/spraying/finishing. In either example, the guitar may be finished with any appropriate look, including application of paints such as metallized paints, stains, decals, insignia, logos or any other design. The guitar may receive a clear protective coat finish or varnish, a polyurethane coat, or any other appropriate finish. In an alternate embodiment, the guitars could be sold in their raw state for customer embellishment/design.

The above-described options focus on the guitar body 12. The technology disclosed may also be applied to larger string instruments that are primarily made of wood, such as cellos, bass guitars, and any other string instrument. The technology disclosed may also be applied to smaller string instruments if desired.

Accordingly, rather than achieving weight reduction by only removing wood, which can weaken the structural integrity of the guitar and negatively alter sound quality, this disclosure provides replacement of removed wood with materials commonly used in aerospace. It is believed that this provides a reduced weight, helping to eliminate fatigue for guitarists. The weight reduction concepts were of primary importance, but without maintaining or enhancing sound quality, musicians would not find the guitars acceptable. Accordingly, the guitars described herein provide a unique combination of honeycomb filled pockets/hollowed portions 14/22 that have been found to enhance the tonal vibration to the pick-up of the guitar, producing long lasting resonant and articulate tones.

Changes and modifications, additions and deletions may be made to the structures and methods recited above and shown in the drawings without departing from the scope or spirit of the disclosure or the following claims.

What is claimed is:

1. An electric guitar, comprising:

a solid wood guitar body comprising one or more hollowed portions from which wood is removed from the solid wood guitar body;

the one or more hollowed portions filled with a honeycomb material; and a guitar cap positioned over the guitar body.

2. The guitar of claim 1, further comprising at least one fabric-like layer positioned in the one or more hollowed portions and in contact with the honeycomb material.

3. The guitar of claim 2, wherein the at least one fabric-like layer comprises a carbon fiber face sheet.

4. The guitar of claim 2, wherein the at least one fabric-like layer comprises a resin impregnated fiberglass face sheet or a fiberglass face sheet and resin system to bond the fiberglass sheet to the guitar body and honeycomb.

5. The guitar of claim 1, wherein the one or more hollowed portions are hour-glass shaped.

6. The guitar of claim 1, wherein the one or more hollowed portions are curved.

7. The guitar of claim 1, wherein the one or more hollowed portions are L-shaped.

8. The guitar of claim 1, wherein the one or more hollowed portions leave at least about ⅛ inch of wood at a base of the one or more hollowed portions.

9. The guitar of claim 1, wherein the one or more hollowed portions leave at least about ⅛ inch of wood material along guitar body sides.

10. An electric guitar, comprising:

a solid wood guitar body comprising one or more hollowed portions from which wood is removed from the solid wood guitar body;

the one or more hollowed portions filled with a honeycomb material; and one or more connecting channels between the one or more hollowed portions and a guitar pick-up location.

11. The guitar of claim 10, wherein the one or more connecting channels comprise one or more sound transmitting/transfer tubing sections positioned therein.

12. The guitar of claim 11, wherein the one or more sound transmitting/transfer tubing sections comprise carbon fiber tubing.

13. A method of manufacturing a lightweight electric guitar, comprising:

providing a solid wood guitar body;

routing one or more openings in the wood guitar body;

applying a resin into the one or more openings;

applying a fabric-like layer into the one or more openings;

applying a honeycomb material into the one or more openings;

applying a guitar cap over at least a portion of the wood guitar body.

14. The method of claim 13, further comprising routing one or more channels in the wood guitar body between the one or more openings and a guitar pickup location and positioning one or more carbon fiber conduits in the one or more channels.

15. The method of claim 13, wherein the at least one fabric-like layer comprises a carbon fiber face sheet.

16. The method of claim 13, wherein the at least one fabric-like layer comprises a resin impregnated fiberglass face sheet.

17. The method of claim 13, further comprising installing electronic hardware and components in a central portion of the guitar body.

18. The guitar of claim 1, wherein the honeycomb material comprises paper having a density of 1.5 to about 4 pounds per cubic foot.

19. The guitar of claim 1, wherein the honeycomb material comprises a height that extends slightly above a depth of the amount of the one or more hollowed portions, such that placement of the guitar cap over the honeycomb material creates compression of the honeycomb material.

20. The guitar of claim 1, wherein, prior to placement of the guitar cap, the honeycomb material extends about 0.001 to about 0.005 inches above the guitar body.

21. The guitar of claim 1, wherein the one or more hollowed portions comprise a depth of about 1.5 inches.

22. The guitar of claim 1, wherein the honeycomb material comprises a height of between about 1 to about 2 inches, prior to positioning of the guitar cap over the guitar body.

* * * * *